United States Patent [19]

Six

[11] Patent Number: 4,830,380

[45] Date of Patent: May 16, 1989

[54] PRINTED MATERIAL BEARING IDENTIFYING CODING

[76] Inventor: Albert J. Six, 22425 Santa Paula Ave., Cupertino, Calif. 95014

[21] Appl. No.: 117,976

[22] Filed: Nov. 9, 1987

Related U.S. Application Data

[60] Division of Ser. No. 894,574, Aug. 8, 1986, which is a continuation-in-part of Ser. No. 622,693, Jun. 20, 1984, Pat. No. 4,628,816.

[51] Int. Cl.[4] ..... A63F 3/06

[52] U.S. Cl. ..... 273/269; 101/426; 283/17; 283/70; 283/74

[58] Field of Search ..... 273/269, 270; 101/76, 101/142, 426; 283/17, 70, 74

[56] References Cited

U.S. PATENT DOCUMENTS 3,822,876 7/1974 Frain ..... 273/269 X

*Primary Examiner*—Anton O. Oechsle

*Attorney, Agent, or Firm*—Fliesler, Dubb, Meyer & Lovejoy

[57] ABSTRACT

A printed upon sheet is divided into a plurality of sequentially longitudinally spaced printing fields having a selected field length, said printing fields each being divided into a plurality of longitudinally and laterally spaced printing domains. The plurality of imprints are divided into a plurality of subsets thereof, said subsets having a null set intersection with each other, the union of all of said subsets of said imprints being a set consisting of all said imprints, each of said subsets of said imprints being sub-divided into a different integral number of sub-subsets of said imprints. The imprints are printed on each of the printing fields on the sheet such that each of the sub-subsets of the imprints is printed on only a selected subset of the longitudinally and laterally spaced printing domains, the printing fields having a null set intersection with one another and the selected subsets of the printing domains having a null set intersection with one another. Coding is printed on the sheet corresponding to each of the printing fields, the coding identifying each of the sub-subsets of the imprints printed on each of the subsets of the longitudinally and laterally spaced printing domains.

3 Claims, 4 Drawing Sheets

PRINTED MATERIAL BEARING IDENTIFYING CODING

CROSS-REFERENCE

This application is a division of co-pending application Ser. No. 894,574, filed Aug. 8, 1986 which is in turn a continuation-in-part of co-pending application Ser. No. 622,693, filed June 20, 1984 now U.S. Pat. No. 4,628,816, issued Dec. 16, 1986.

TECHNICAL FIELD

The invention relates generally to a printing apparatus and more particularly relates to a printing apparatus which is useful for preparing a very large but finite number of non-identical printed patterns of printed material before repetition of any particular pattern.

BACKGROUND ART

In certain instances it is desirable to be able to reproduce many different patterns by printing before any one pattern is repeated. For example, in many states it is legal to play such games as bingo for the purpose of gambling. Generally, the prospective player purchases one or more bingo sheets, each of which will usually contain several bingo faces (five by five arrays), and then proceeds to play bingo in the usual manner simultaneously on each of the bingo faces. At the end of the game the bingo sheets are discarded after the winners have been determined and paid. Since a number of people may be playing bingo at the same time, it is highly desirable that each of the persons playing bingo have different sheets. Otherwise, more than one person would win at the same time using the identical bingo face. Accordingly, it is desirable to be able to print a large number of different bingo sheets, each having different bingo playing faces on them. In the past this problem has never been successfully solved.

According to John Scarne, *Scarne's Guide to Casino Gambling,* p. 313 (Simon and Schuster 1978), the number of bingo faces that could be printed is (24 numbers selected at random from 75 numbers):

111,007,923,832,370,565 but only about 9000 bingo faces are presently being used. These 9000 bingo faces represent a surface of 1000 square feet of printed paper. This is much larger than the surface area of a cylinder of a Webb press. Manufacturers of bingo sheets thus have to print the 9000 squares over 50 or more runs and then cut and assemble them like the pieces of a puzzle. Hence, today's manufacturers are in the position of the printer of a puzzle who has to separately print every piece of a multiplicity of puzzles, and then assemble them.

Moreover, the market is requesting larger and larger series. As bingo has become more popular, bingo games have included more than 1000 players, each one using 12 or 18 bingo faces simultaneously for 20 or 30 games. Five hundred thousand bingo faces can be used in one night by a single bingo operator. In some states, duplicate winners share the prize (winners resent it). In other states, the operator has to pay the full prize to every winner (the operator resents it). In both cases there is pressure on the manufacturers to increase the number of bingo faces without duplicates.

The use of a small (9000) series necessitates two precautions: (1) to print different color frames or outlines on each sheet to differentiate the sheets of one series from the sheets of the next series; up to 20 colors are used which necessitates an inventory of 20 times 50 runs; and (2) to print a serial number on every bingo face to identify bingo faces of the same series. Sheets from the same run are printed with different serial numbers This makes assembling the pieces of the puzzle even more difficult.

Previously, large runs have been made of identical bingo sheets within each run. Large numbers of such runs have been made with the sheets from each run having different bingo faces. Then, collation has been carried out to provide sets of non-identical bingo sheets with each set having a large number of different sheets. To be able to provide such sets of different sheets, the printers have had to maintain truly huge inventories. The problem is further exacerbated by the requirement that the sets be available in several (generally twelve) different color combinations so that sheets from one game cannot become confused during play with sheets from previous games.

While printing is, of course, a quite old art and a number of wet printing machines are known, none will solve the above described problem. For example, some of this art is described in U.S. Pat. No. 1,973,034, issued Sep. 11, 1934 to H. V. Ball, U.S. Pat. No. 3,015,266, issued Jan. 2, 1962 to C. U. Anderson et al., U.S. Pat. No. 3,621,780, issued Nov. 23, 1971 to J. S. Tillotson, and U.S. Pat. No. 3,083,640, issued Apr. 2, 1963 to C. Milner. Such printing machinery as is shown in the four just-mentioned patents is designed primarily for producing multicolor printing on various media.

U.S. Pat. No. 3,083,640 discloses a particularly interesting apparatus for irregularly dyeing yarn. Parallel strands of yarn are fed through an apparatus having a series of printing rolls having different effective radii and circumferences. It is required that the circumference of the largest roll and the circumference of at least one of the other rolls in the series be in fractional relationship as opposed to whole number relationship. In this manner, an irregularly dyed series of strands of yarn are prepared. As will be apparent, such an apparatus is not useful for printing bingo sheets or other patterns having a series of separate images which must be specifically positioned.

A security problem also exists with bingo sheets. Players have been known to attempt to cheat by altering the face of the card so that they have apparently won. For example, the number 3 is sometimes modified to look like the number 8 if the number 8 would lead to a win situation for the player. When there are only nine thousand bingo faces used before repitition, the persons or firm running the game can keep a book with the nine thousand bingo faces shown in it and can affix a serial number to each bingo sheet, for example a number from 1 to 9000, and then check each purported winder against the book. If larger numbers of non-repetitive bingo faces should become available, for example as taught hereinbelow, such a method would not be practical. For example, if one could produce one million bingo sheets without repitition, even if each such sheets bore a serial number from 1 to 999,999, one would need a book one million pages long to check each purported winning bingo face. As a practical matter such would be impossible.

DISCLOSURE OF THE INVENTION

The present invention is directed to overcoming one or more of the problems as set forth above.

In accordance with one embodiment of the present invention, a printing apparatus is set forth which is adapted for printing a plurality of imprints onto a sheet divided into a plurality of sequentially longitudinally spaced printing fields having a selected field length, the printing fields each being divided into a plurality of longitudinally and laterally spaced printing domains. The printing apparatus includes means for dividing the plurality of imprints into a plurality of subsets of said imprints, each of said subsets of said imprints having a null set intersection with each other of said subsets of imprints, the union of al of said subsets of imprints being a set consisting of all of said plurality of imprints, each of said subsets of said imprints being subdivided into a different integral number of sub-subsets of said imprints. The apparatus also include means for printing the imprints onto each of the printing fields on the sheet such that each of said sub-subsets of each of said subsets of said imprints prints on only a selected subset of said longitudinally and laterally spaced printing domains, said printing fields having a null set intersection with one another and said selected subsets of said printing domains having a null set intersection with one another. The apparatus further includes means for sequentially indexing each of the sub-subsets of said imprints a controlled number of said sub-subsets of said imprints following printing of each one of said sub-subsets of said imprints on each successive one of said printing fields.

In accordance with another embodiment of the present invention a method is set forth of printing a piurality of imprints onto a sheet divided into a plurality of sequentially longitudinally spaced playing fields having a selected field length, the printing fields each being divided into a plurality of longitudinally and laterally spaced printing domains. The method comprises dividing the plurality of imprints into a plurality of subsets of said imprints, each of said subsets of said imprints having a null set intersection with each other of said subsets of said imprints, the union of all of said subsets of imprints being a set consisting of all of said plurality of imprints, each of said subsets of said imprints being subdivided into a different integral number of sub-subsets of said imprints. The method further comprises printing the imprints onto each of the printing fields on the sheet such that each of said sub-subsets of each of said subsets of said imprints prints on only a selected subset of said longitudinally and laterally spaced printing domains, said printing fields having a null set intersection with one another and said selected subsets of said printing domains having a null set intersection with one another. The method also includes sequentially indexing each of the sub-subsets of said imprints a controlled number of said sub-subsets of said imprints following printing of each one of said sub-subsets of said imprints on each successive of said printing fields.

In accordance with yet another embodiment of the present invention a printed upon sheet is set forth which is divided into a plurality of sequentially longitudinally spaced printing fields having a selected field length, said printing fields each being divided into a plurality of longitudinally and laterally spaced printing domains. Each of the printing fields is divided into a plurality of subsets of the printing domains, the union of which yields the printing fields and the intersection of which is a null set. The imprints printed on each respective one of said selected subsets of said longitudinally and laterally spaced printing domains are selected from a respective subset of said imprints, each of said subsets of said imprints having a null set intersection with each other of said subsets of imprints, the union of all of said subsets of imprints being a set consisting of all of said plurality of imprints, each of said subsets of said imprints being subdivided into a different integral number of sub-subsets of said imprints. The sheet also includes coding thereon, the coding identifying each of said sub-subsets of said imprints.

When an apparatus, method and sheet in accordance with the present invention are utilized, one can readily print literally millions of different bingo sheets without obtaining any repeated patterns The printed material which issues from an apparatus or process in accordance with the present invention has sequentially changed bingo faces on it whereby there is no necessity to collate long runs of a series of identical bingo sheets or other printed material in order to obtain a stack having all different bingo sheets. Alterations of bingo sheets in accordance with the present invention can be readily detected by reading the coding on the sheet and comparing it with a list of sub-subsets of imprints in relatively short book, or utilizing a memory devices such as a general purpose or specialized computer. Yet, such comparison can take place even though there are great number of bingo sheets producible without repitition.

BRIEF DESCRIPTION OF DRAWINGS

The invention will be better understood by reference to the figures of the drawings wherein.

BEST MODE FOR CARRYING OUT THE INVENTION

Figure 1A:
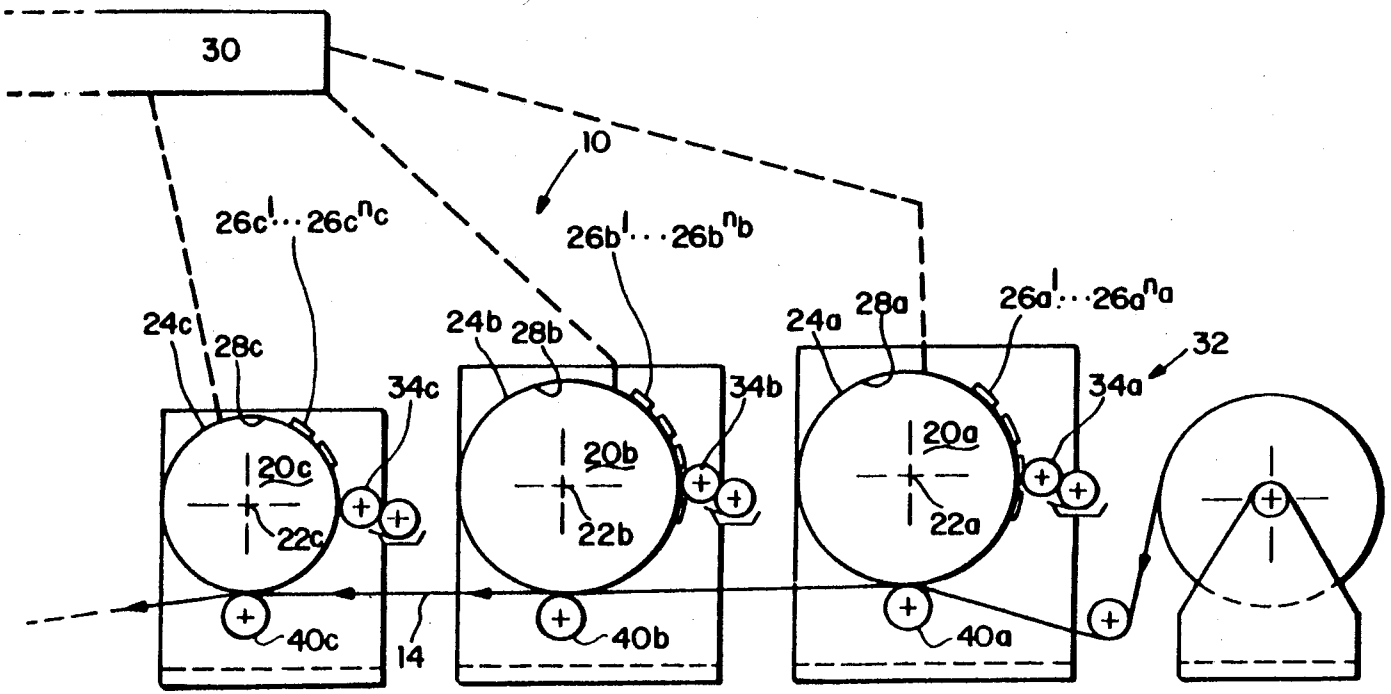
FIG. 1 (separated, because of size into FIGS. 1A and 1B as shown schematically in FIG. 1) illustrates, in side schematic view, an apparatus in accordance with the present invention.
Figures 1, 1A, 1B:
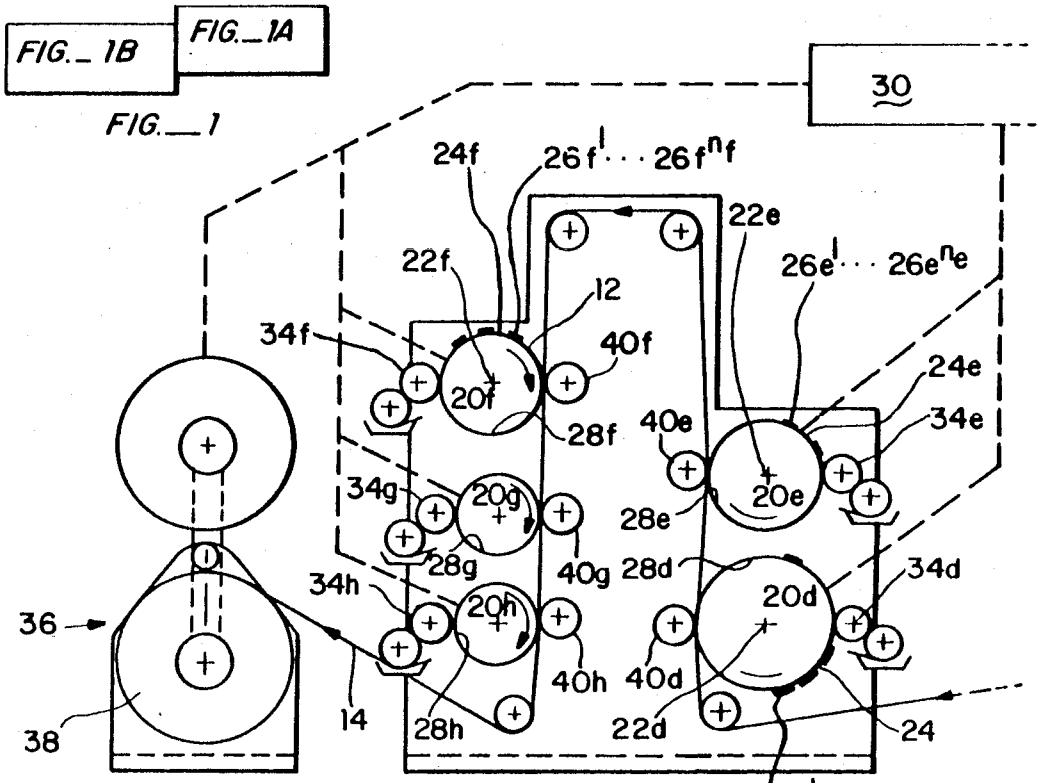
Figure 2:
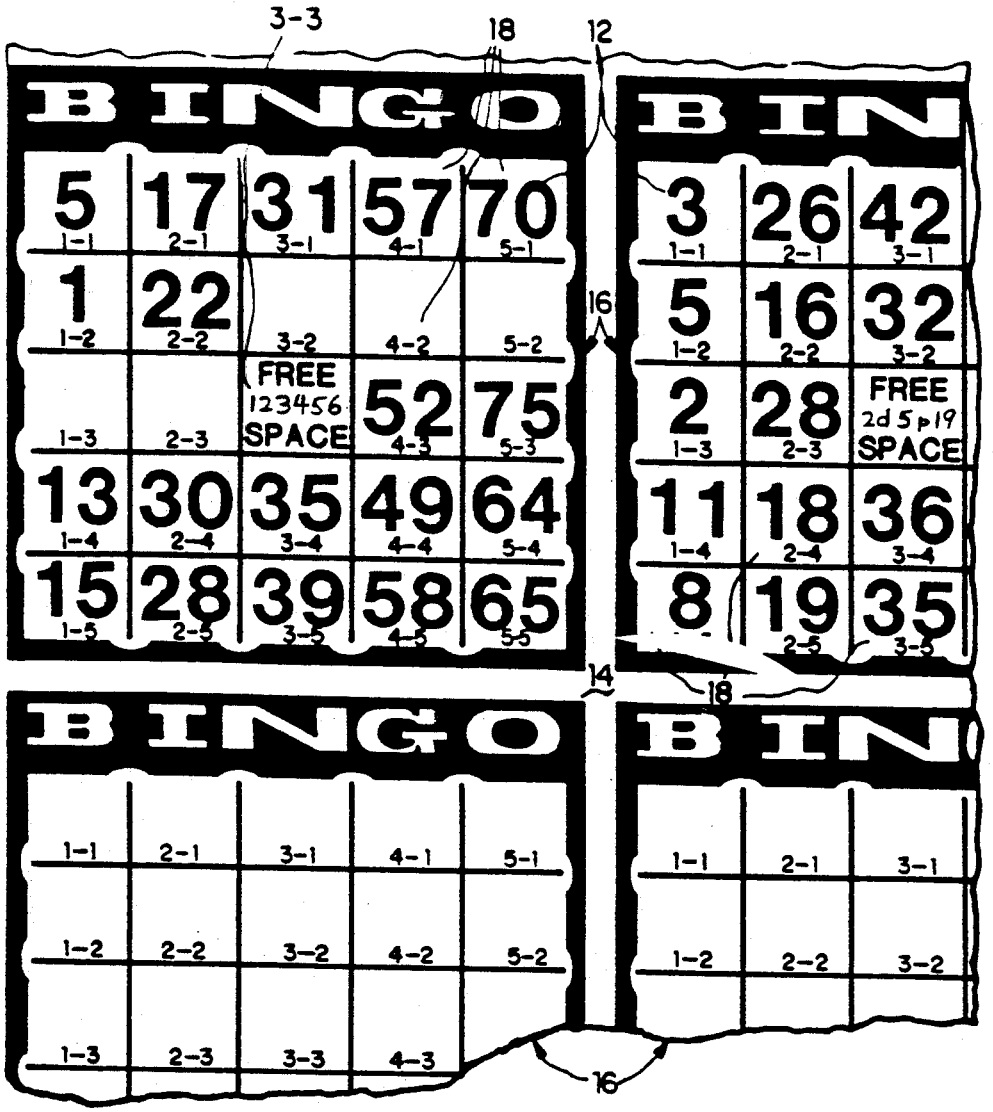
FIG. 2 illustrates a bingo sheet produced in accordance with an apparatus in accordance with the present invention.
Figure 3:
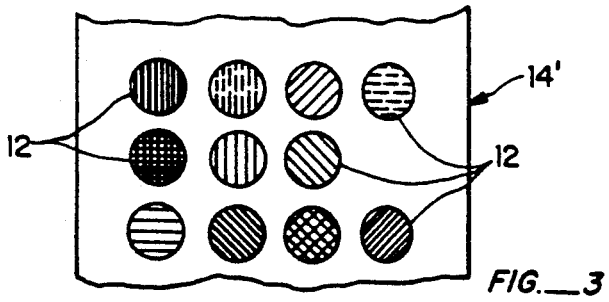
FIG. 3 illustrates a bingo face which is part of a bingo sheet which includes coding thereon in accordance with the present invention.

Adverting to FIGS. 1 and 2, a printing machine 10 is illustrated which is adapted for printing a plurality of imprints 12 onto a sheet 14 which is divided into a plurality of sequentially longitudinally spaced printing fields 16 having a selected field length and generally being subdivided into a plurality of longitudinally and laterally spaced printing spaces or domains 18.

In accordance with the present invention, and as will be seen most clearly in FIGS. 1A–1B, a plurality of spaced printing rolls 20*a*–20*f* are provided having respective parallel axes 22*a*–22*f* and peripheral cylindrical surfaces 24*a*–24*f*. The rolls 20*a*–20*f* have image transfer regions $26a^1 \ldots 26a^{na}$–$26f^1 \ldots 26f^{nf}$ (e.g., fonts) which are adapted to print the imprints 12 (some omitted for clarity) onto the sheet 14. The image transfer regions $26a^1 \ldots 26a^{na}$–$26f^1 \ldots 26f^{nf}$ are positioned apart from one another along respective circumferences 28*a*–28*f* of the rolls 20*a*–20*f* a distance equal to the field length of the printing fields 16.

Furthermore, the circumferences 28*a*–28*f* are each different integral multiples of the field length of the printing fields 16 and are not integral multiples of one another. Thus, each of the cylindrical surfaces 28*a*–28*f* have a subset of the image transfer regions $26a^1$–$26f^{nf}$ print the imprints 12 on only a selected subset of the printing domains 18. Furthermore, in accordance with one preferred embodiment of the present invention, the selected subsets of the printing domains 18 have a null set intersection. That is, each subset of image transfer regions $26a^1$–$26f^{nf}$ prints on a unique subset of printing 18.

The above concept may be more easily understood by reference to a specific example, namely the example wherein a bingo sheet as illustrated in FIG. 2 is printed utilizing such an apparatus. For simplicity we shall consider the printing roll 20*f*. The field length, by reference to FIG. 2, is the length of one bingo face plus assorted writings, e.g., the word "BINGO". Let us assume that the roll 20*f* is precisely twelve field lengths in circumference. Let us assume further that the roll 20*f* prints numbers onto four selected squares or domains 18 on each bingo face on the sheet 12 (one-sixth of the 24 squares other than the "free" square). For the sake of simplicity, we will assume that the four domains on which the roll 20*f* prints are the domains designated 1-1, 1-2, 1-3 and 1-4 in FIG. 2.

The image transfer regions (of the set $26f^1$–$26f^{nf}$) on roll 20*f* which are positioned to print in the domain 1-1 print in that domain on each of the longitudinally sequential bingo faces (printing fields) 16 on the sheet 14. It should be noted that the numbers present in the first column (1-1, 1-2, 1-3, 1-4 and 1-5) on the printing field 16 are the numbers 1-15 in accordance with the rules of bingo. Accordingly, each of the five domains 1-1 through 1-5 may be restricted to having three numbers (one-fifth of the numbers 1-15) printed thereon while each of the other domains 1-1 through 1-5 may not have any of the numbers printed thereon which are printed in any of the other such domains. For example, the domain 1-1 may be limited to having printed thereon the numbers 1, 2 and 3. Next, the domain 122 may be limited to having printed thereon the numbers 4, 5 and 6, etc. The image transfer regions on roll 20*f* which print on the domain 1-1 will then have the numerals 1, 2 and 3 randomly arranged thereon and of substantially equal probability of being printed. For example, the sequence could be 1-3-2-3-1-2-1-2-3-2-3-1. This would provide a sequence of numbers in the domain 1-1 which would be repeated after every twelve longitudinally sequential bingo faces were printed. Generally, although the numbers being printed by the roll 20*f* have been discussed as being all in the column 1, such numbers would be scattered about the cards so as to make detection of such a sequence more difficult. Also, generally each corner printing domain 18 would be printed by a different one of the rolls 20*a*–20*f*. This would be done to allow playing a variation of bingo wherein drawing the numbers in all four corner domains 18 leads to a win.

At the same time, the roll 20*e* might have a circumference thirteen times the field length of the printing field 16. In this manner, those domains 18 which are printed upon by the roll 20*e* would start repeating after thirteen longitudinally spaced printing fields 16 had been printed upon. Because of the offset between the repetition after twelve longitudinally spaced printing fields 16 are printed upon by roll 20*f* and thirteen longitudinally spaced printing fields 16 are printed upon by roll 20*e*, one would obtain twelve times thirteen combinations. This assumes that each of the rolls 20*a*–20*f* index a controlled number, generally one, of the numbers on the respective rolls 20*a*–20*f* following printing on each successive of the printing fields 16.

Sequentially, the roll 20*d* might have a circumference of seventeen printing fields 16, the roll 20*c* might have a circumference of nineteen printing fields 16, the roll 2*b* might have a circumference of twenty-three printing field 16 and the roll 20*a* might have a circumference of twenty-nine printing fields 16. As will be noted, the product of twelve times thirteen times seventeen times nineteen times twenty-three times twenty-nine leads to over two hundred million printings before a repetition occurs.

The additional printing rolls 20*g* and 20*h* can be utilized to print repetitive subject matter such as the grid of the card, the background color upon which the word "bingo" appears, or the like. Such might be in different colors than is the printing of the numbers upon the spaces on the bingo playing faces 16.

Means 30, comprising essentially control circuitry of a conventional nature, is used for rotating the rolls 20*a*–20*f* about their axes 22*a*–22*f* at a velocity such that the cylindrical surfaces 24*a*–24*f* have equal tangential velocities. This is to assure smear-free printing. Means 32 is provided for transferring an image reproducing medium onto each of the image transfer regions $26a^1$–$26f^{nf}$. In the embodiment illustrated, the image reproducing medium transferring means 32 simply comprises a plurality of conventional inking rolls 34*a*–34*f*.

Means 36 is provided for longitudinally moving the sheet 14 generally tangentially sequentially adjacent each of the cylindrical surfaces 24*a*–24*f* at a velocity such that the sheet 14 and the cylindrical surfaces 24*a*–24*f* have zero relative velocity difference. The longitudinal moving means 36, in the embodiment illustrated, simply comprises a takeup reel 38 conventionally motor-powered to motivate the sheet 14 from right to left in FIG. 1. Other longitudinal moving means 36 can be utilized and, for example, it may be preferable to cut the sheet 14 as it exits the roll 20*h* into the desired sheet length.

Also in accordance with the present invention, means 40*a*–40*f* is provided for transferring the image reproducing medium from the image transfer regions $26a^1$–$26f^{nf}$ domains 18 as the sheet 14 moves opposite the aforesaid image transfer regions $26a^1$–$26f^{nf}$. The transferring means 40*a*–40*f*, in the embodiment illustrated, merely comprises a plurality of rollers 40*a*–40*f* which cause the sheet 14 to contact the image transfer regions $26a^1$–$26f^{nf}$. transferred to the sheet 14.

It may also be desirable to provide means for drying the sheet 14 following transferring of the image reproducing medium to the printing domains 18. Such drying means is not illustrated because of its conventional nature, but might consist of air drying chambers through which the sheet 14 is passed intermediate some of the rollers 28*a*–28*f* or after exit from the last of the rollers 20*h*.

As may be seen in FIG. 2, each of the printing fields 16 may comprise a five by five orthogonal array of spaces 18 which comprise the printing domains and which define the bingo face 16. A central one 3-3 of the spaces 18 is normally designated a "free" space in such a situation. As explained above, in such a situation, each of the subsets of image transfer regions $26a^1$–$26f^{nf}$ positioned to print. The imprints 12 on only a selected subset of the spaces 18 and the imprints 12 then comprise only a selected set of numbers. As is seen in FIG. 2, the selected set of numbers would include the numbers 1–75 positioned as normally on a bingo card with the numbers 1–15 in the leftwardmost column, numbers 16–30 in the next rightward column, numbers 31–45 in the next rightward column, numbers 46–60 in the next rightward column, and the numbers 61–75 in the rightwardmost column. In such a situation there are twenty-four domains 18 on each playing field 16.

In accordance with a preferred embodiment of the invention, each of the six rolls 20*a*–20*f* will print the imprints 12 in three to five of the spaces 18 with the number of image transfer regions 26*a*$^1$–26*f*$^{n}$*f* being positioned to print the imprints 12 in each of the three to five spaces 18 being equal to the circumference of the rolls 20*a*–20*f* bearing such image transfer regions 26*a*$^1$–26*f*$^{n}$*f* divided by the field length and with the image transfer regions 26*a*$^1$–26*f*$^{n}$*f* being positioned to print the imprints 12 in each one of the three to five spaces being positioned apart from one another along the respective one of the circumferences 28*a*–28*f* a distance equal to the field length.

Again referring to FIG. 2, it will be seen that the sheet 14 will generally have a plurality of sequentially laterally spaced printing fields 16. This will provide bingo playing sheets 14 having several bingo faces 16 on them as is now conventional. For example, the plurality of laterally spaced playing fields 16 may be four or six or eight and the sheet 16 may be appropriately cut to across playing fields 16 by four longitudinally down playing fields 16.

Also in accordance with the present invention a method is set forth of printing a plurality of imprints 12 onto a sheet 14 divided into a plurality of sequentially longitudinally spaced printing fields 16 having a selected field length. The method comprises feeding the sheet 14 past the plurality of rolls 20*a*–20*f* as previously discussed while rotating the rolls, also as previously discussed, transferring an image reproducing medium onto image transfer regions 26*a*$^1$–26*f*$^{n}$*f* transferring the image reproducing medium from the image transfer regions 26*a*$^1$–26*f*$^{n}$*f* to the printing fields 16 as they pass opposite the respective image regions 26*a*$^1$–26*f*$^{n}$*f*.

In a more general sense it will be noted that the rolls 20*a*–20*f* can be considered to be means for dividing the plurality of imprints 12 into a plurality of subsets of said imprints 12, each of the subsets of said imprints 12 having a null set intersection with each other of the subsets of the imprints 12, the union of all of the subsets of imprints 12 being a set consisting of all of the plurality of imprints 12, each of the sub-sets of the imprints 12 being divided into a different integral number of sub-subsets of the imprints 12. That is, the roll 20*a* may have one subset of the imprints 12, the roll 20*b* may have another subset of the imprints 12, etc. By making the diameters of the various rolls 20*a*–20*f* different integral multiples of the field length of the printing field 16, it has been assured that each of the subsets of the imprints 12 is further sub-divided into a different integral number of the sub-subsets of the imprints 12.

Also, it is clear that the printing rolls 20*a*–20*f* serve as means for printing the imprints 12 onto each of the printing fields 16 on the sheet 14 such that each of the sub-subsets of each of the subsets of the imprints 12 prints on only a selected subset of the longitudinally and laterally spaced printing domains 18, the printing fields 16 having a null set intersection with one another and the selected subsets of the printing domains 18 having a null set intersection with one another.

It should also be noted that each of the circumferences of the rolls 20*a*–20*f* is a different integral multiple of the field length of the printing field 16. In this manner, means are provided for sequentially indexing each of the sub-subsets of the imprints a controlled, generally an equal, number of the sub-subsets of the imprints following printing of each one of the sub-subsets of the imprints 12 on each successive of the printing fields 16. For example, the roll 20*a* may have five sub-subsets, the roll 20*b* may have six sub-subsets, etc. If each roll indexes one field length per printing (or two, or three, or however many) each of the sub-subsets is indexed a controlled number of sub-subsets.

Further in accordance with the present invention a method is set forth of printing onto a sheet 14 divided into a plurality of sequentially longitudinally spaced playing fields 16 having a selected field length. This method comprises dividing the plurality of imprints into a plurality of subsets of said imprints 12, each of said subsets of said imprints 12 having a null set intersection with each other of said subsets of imprints 12, the union of all of said subsets of imprints 12 being a set consisting of all of said plurality of imprints, each of said subsets of said imprints being sub-divided into a different integral number of sub-subsets of said imprints 12. The method further comprises printing said imprints 12 onto each of said printing fields 16 on said sheet 14 such that each of said sub-subsets of each of said subsets of said imprints 12 prints on only a selected subset of said longitudinally and laterally spaced printing domains 18, said printing fields having a null set intersection with one another and said selected subsets of said printing domains 18 having a null set intersection with one another. The method further comprises sequentially indexing each of said sub-subsets of said imprints 12 an equal number of said sub-subsets of said imprints following printing of each one of said sub-subsets of said imprints 12 on each successive of said printing fields 16.

Figure 4:
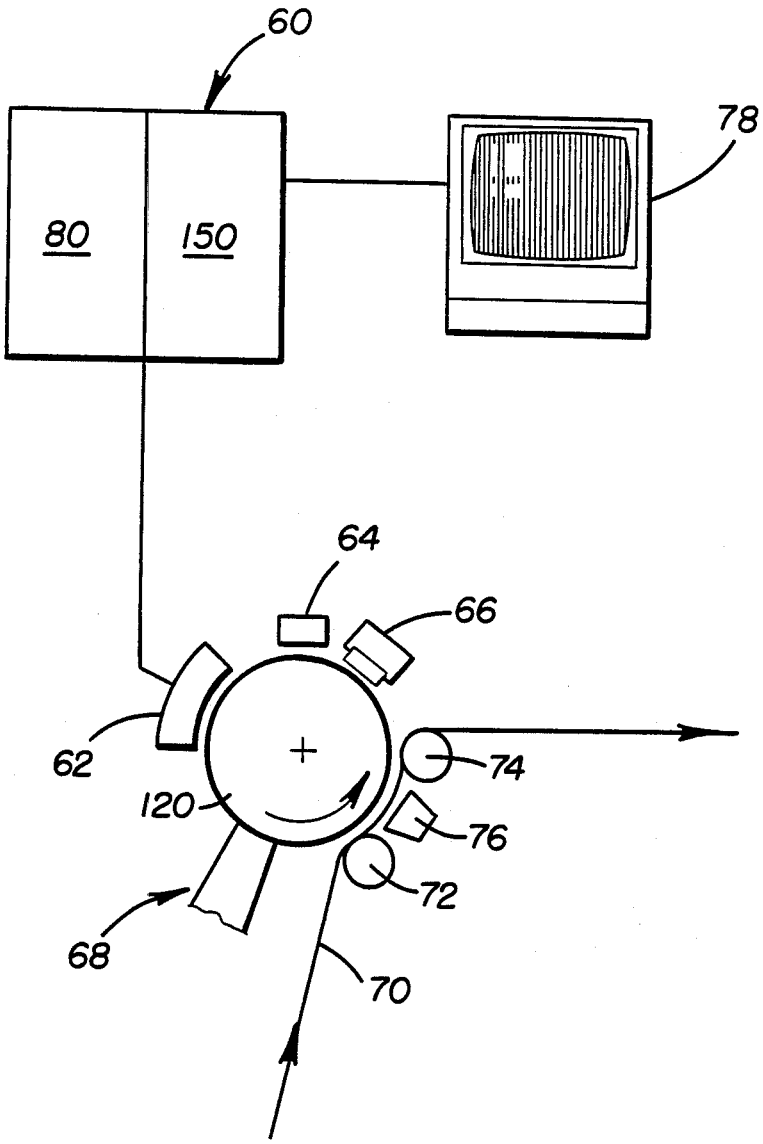
FIG. 4 illustrates, schematically, an alternative apparatus in accordance with the present invention.

FIG. 4 illustrates an alternative embodiment of the invention wherein a single printing roll 120 takes the place of each of the printing rolls 20*a*–20*f*. In the embodiment of FIG. 4 a computer 60 controls the content of the material being printed by the printing roll 120. A drum 120 serves as a single printing roll and rotates in the direction indicated by an arrow. The computer 60 controls, for example, recording heads 62. Appropriate erase head 64 cleaning station 66 and toner assembly 68 are present. Paper 70 is guided by rollers 72 and 74 past transfer station 76. The paper 70 is generally cut after it leaves the roller 74. The term printing is used in the broader sense and includes such modern techniques as xerographic laser printing, magnetic drum printing, etc., and is not meant to nor should it be implied to, require the transfer of ink or any other printing fluid. Thus, printing is broadly defined as any process by which an imprint is provided upon a sheet. A commercial apparatus whch can be adapted by proper programming as described herein, to serve as the embodiment of FIG. 4 is the Cynthia MP 6090 Page Printer (trademark) sold by Bull Peripheriques and described in detail in Cynthia MP 6090 Page Printer Product Specification, 1985.

Utilizing the apparatus of FIG. 4 the single printing roll 120 prints each printing field 16 in a single pass and at the same time prints appropriate coding on or adjacent each printing field 16. The computer 16 includes means 150, generally in the nature of appropriate programming, for dividing the plurality of imprints into a plurality of subsets of said imprints, each of said subsets of said imprints having a null set intersection with each other of said subsets of said imprints, the union of all of said subsets of imprints being a set consisting of all of said plurality of imprints, each of said subsets of said imprints being subdivided into a different integral number of sub-subsets of said imprints. The computer internally determines the coding by having the coding correspond, for example on a digit by digit basis, to the particular sub-subset of each of the subsets of imprints which are printed on respective of the subsets of the longitudinally and laterally spaced printing domains 18. If the coding is a six digit number such as 123456 the digit "1" on the left would represent a specific sub-subset of the imprints. Similarly, the digit "2" next to the left would represent a specific sub-subset of the imprints, etc. A six (or whatever number is convenient) digit alphabetic "number" e.g., abcdef, or a mixed alphanumeric "number" may be used thus greatly increasing the number of bingo faces which may be printed without repetition.

The computer 16 also generally includes means 80, generally in the nature of appropriate programming, for sequentially indexing each of the sub-subsets of the imprints a controlled, generally an equal number of said sub-subsets of the imprints following printing of each one of the sub-subsets of the imprints on each successive of the printing fields.

In accordance with one embodiment of the present invention the computer also includes or control means 78 for displaying any printed playing field 16, or, if desired, for printing an additional identical playing field 16, when the coding is read into the computer. Thus, one can verify that a card has not been altered by simply reprinting the same card, or more likely by displaying the same card. Alternatively, a book may be printed up having therein each of the sub-subsets of each of the subsets of imprints along with the corresponding coding. In such an instance one can quickly leaf through the book to locate the correct imprints to appear in each of the subsets of the longitudinally and laterally spaced printing domains 18 and compare with a suspect bingo card.

The advantage of a more modern printing method as illustrated in FIG. 4 is that only a single printing roll 120 need by utilized whereby equipment size and cost can be minimized.

INDUSTRIAL APPLICABILITY

The apparatus 10 and method of the present invention are particularly useful for printing bingo sheets 14. The bingo sheets 14 made in this manner are particularly useful in that one can readily check to see whether or not they have been altered. Large numbers of non-reproducing ordered patterns can be produced when operating in accordance with the present invention.

While the invention has been described in connection with certain specific embodiments thereof, it is understood that such description was for convenience only and that other uses, advantages and objects of the invention will become apparent to one skilled in the art from the foregoing description and the accompanying drawings and that the invention includes such uses, advantages and objects.

I claim:

1. A printed upon sheet which is divided into a plurality of sequentially longitudinally spaced printing fields having a selected field length, said printing fields each being divided into a plurality of longitudinally and laterally spaced printing domains, each of said printing fields being divided into a plurality of subsets of said longitudinally and laterally spaced printing domains, the union of said subsets of said printing domains yielding said printing fields and the intersection of said subsets of said printing domains yielding a null set; a set of a plurality of imprints printed on said domains on said printing fields, the imprints printed on each of said selected subsets of said longitudinally laterally spaced printing domains being selected from a subset of said imprints, each of said subsets of said imprints having a null set intersection with each other of said subsets of said imprints, the union of all of said subsets of said imprints being said set of said plurality of said imprints, each of said subsets of said imprints being subdivided into a different integral number of sub-subsets of said imprints; and coding printed on said sheet corresponding to each of said printing fields, said coding having components identifying and corresponding in a one-to-one relationship to each of said sub-subsets of said imprints printed on each of said subsets of said longitudinally and laterally spaced printing domains.

2. A sheet as set forth in claim 1, in combination with means for comparing the imprints on a selected subset of said longitudinally and laterally spaced printing domains with the sub-subset of said set of said plurality of imprints which said coding verifies should appear on said selected subset of said longitudinally and laterally spaced printing domains.

3. A printed upon sheet which is divided into a plurality of sequentially longitudinally spaced printing fields having a selected field length, said printing fields each being divided into a plurality of longitudinally and laterally spaced printing domains, each of said printing fields being divided into a plurality of subsets of said longitudinally and laterally spaced printing domains, the union of said subsets of said printing domains yielding said printing fields and the intersection of said subsets of said printing domains yielding a null set; a set of a plurality of imprints printed on said domains on said printing fields, the imprints printed on each of said selected subsets of said longitudinally laterally spaced printing domains being selected from a subset of said imprints, each of said subsets of said imprints having a null set intersection with each other of said subsets of said imprints, the union of all of said subsets of said imprints being said set of said plurality of said imprints, each of said subsets of said imprints being subdivided into a different integral number of sub-subsets of said imprints; and coding printed on said sheet corresponding to each of said printing fields, said coding having components each identifying a respective single one of each of said sub-subsets of said imprints printed on each of said subsets of said longitudinally and laterally spaced printing domains.

* * * * *